US010011466B1

(12) United States Patent
Nielsen et al.

(10) Patent No.: US 10,011,466 B1
(45) Date of Patent: Jul. 3, 2018

(54) LIFTING BAG DEVICE WITH RECESSED GAS INLET

(71) Applicant: Paratech, Inc., Frankfort, IL (US)

(72) Inventors: Kenneth E. Nielsen, Chicago, IL (US); William O. Teach, Frankfort, IL (US); James C. Laski, Bourbonnais, IL (US)

(73) Assignee: Paratech, Incorporated, Frankfort, IL (US)

( * ) Notice: Subject to any disclaimer, the term of this patent is extended or adjusted under 35 U.S.C. 154(b) by 533 days.

(21) Appl. No.: 14/675,019

(22) Filed: Mar. 31, 2015

(51) Int. Cl.
*B66F 3/35* (2006.01)
*B66F 3/40* (2006.01)

(52) U.S. Cl.
CPC . *B66F 3/35* (2013.01); *B66F 3/40* (2013.01)

(58) Field of Classification Search
USPC ..... 254/93 HP; 137/230, 231, 232
See application file for complete search history.

(56) References Cited

U.S. PATENT DOCUMENTS 3,744,756 A * 7/1973 Smith ..... B66F 3/35 254/93 HP
4,104,425 A * 8/1978 Hirmann ..... A47C 27/081 114/49
4,372,533 A * 2/1983 Knaus ..... B66F 3/35 254/93 HP
4,643,398 A * 2/1987 Vetter ..... B29D 22/00 254/93 HP
7,029,245 B2 * 4/2006 Maianti ..... A61M 1/1037 137/512
7,070,167 B1 * 7/2006 Bacon ..... B66F 7/0625 254/10 C
2014/0130895 A1 * 5/2014 Marie Hinque ..... B60C 23/12 137/231

OTHER PUBLICATIONS

Maxiforce® Air Lifting Bags, Maximum Force Where You Need It Most!, Apr. 2002, 10 pages.

* cited by examiner

*Primary Examiner* — Joseph J Hail
*Assistant Examiner* — Shantese McDonald
(74) *Attorney, Agent, or Firm* — Banner & Witcoff, Ltd.

(57) ABSTRACT

A lifting device including a recessed inlet molded into an envelope structure of the lifting device at a notch section. The notch section, in turn, may include one or more protruding surfaces configured to protect the inlet, or air hose coupling attached to the inlet, from contact (e.g. falls/bumps) that may otherwise damage one or more of the air hose coupling or the recessed inlet while the lifting device is being stored, deployed, or used.

21 Claims, 6 Drawing Sheets

LIFTING BAG DEVICE WITH RECESSED GAS INLET

BACKGROUND

A lifting bag device that may be utilized in time-sensitive, or emergency situations may be subject to numerous bumps/knocks as it is being deployed, used, and/or stored. An air inlet, through which compressed air may be injected to inflate the lifting bag device, may represent an area that is vulnerable to damage as a result of this contact during deployment, use, and/or storage. Accordingly, aspects of this disclosure relate to an improved lifting bag device.

BRIEF SUMMARY

According to one aspect, an emergency lifting device may have a lifting bag that expands between a deflated configuration and an inflated configuration once filled with compressed air. The lifting bag may have a top surface, a bottom surface, and at least four sides. The lifting device may further have an envelope structure that is coupled to the at least four sides, and may have a first outer edge at a first distance from the center of the lifting device. Additionally, the envelope structure may have a notch section that has a second outer edge at a second distance away from the center of the lifting device, such that the second distance is less than the first distance. The envelope structure may also have a recessed inlet molded into the envelope structure. The recessed inlet may extend from the second outer edge of the envelope structure to a cavity of the lifting bag. The recessed inlet may have a substantially cylindrical body, and at least two wing structures attached to an outer surface of the cylindrical body. The two wing structures may extend in a radial direction relative to the substantially cylindrical body. Further, the two wing structures may resist an internal pressure from within the lifting bag when in the inflated configuration. The recessed inlet may have a bore with an axial length extending between the second outer edge of the envelope structure and the cavity of the lifting bag. A portion of the axial length of the bore may have a threaded sidewall. Further, a portion of the envelope structure may be configured to deflect towards the center of the lifting device when the lifting bag is expanded between the deflated configuration and the inflated configuration.

In another aspect, a lifting device may have a lifting bag that expands between deflated configuration and an inflated configuration when filled with compressed gas. The lifting bag may have a top surface, a bottom surface, and at least four sides. The lifting device may further have an envelope structure that is coupled to the at least four sides. Additionally, the envelope structure may have a notch section that has at least one protective bumper surface adjacent to a recessed inlet. The recessed inlet may be molded into the envelope structure and extend from an outer edge of the notch section to a cavity of the lifting bag. The recessed inlet may further have a substantially cylindrical body, and at least one adhesion structure. The adhesion structure may resist an internal pressure from within the lifting bag when in the inflated configuration. Additionally, the recessed inlet may have a bore with an axial length extending between the outer edge of the envelope structure and the cavity of the lifting bag. A portion of the axial length of the bore may have a threaded sidewall. Additionally, a portion of the envelope structure may be configured to retain a same geometry when the lifting bag is expanded between the deflated configuration and the inflated configuration.

In yet another aspect, a lifting device may have a lifting bag that expands between a deflated configuration and an inflated configuration when filled with compressed gas. The lifting bag may have a top surface, a bottom surface, and at least three sides. The lifting device may further have an envelope structure that is attached to the at least three sides. Additionally, the envelope structure may have a notch section that has at least one protective bumper surface adjacent to a recessed inlet. The recessed inlet may be molded into the envelope structure of the notch section, and extend from an outer edge of the envelope structure to a cavity of the lifting bag. The recessed inlet may have a substantially cylindrical body, and a bore with an axial length extending between the outer edge of the envelope structure and the cavity of the lifting bag.

BRIEF DESCRIPTION OF THE DRAWINGS

The present disclosure is illustrated by way of example and not limited in the accompanying figures in which like reference numerals indicate similar elements and in which.

Further, it is to be understood that the drawings may represent the scale of different component of one single embodiment; however, the disclosed embodiments are not limited to that particular scale.

DETAILED DESCRIPTION

Aspects of this disclosure relate to a lifting device including a lifting bag configured to be inflated in order to lift, or otherwise move a first object away from a second object or surface. In particular, the described lifting device may include a recessed inlet, molded into an envelope structure of the lifting device at a notch section. The notch section, in turn, may include one or more protruding surfaces. Further, the one or more protruding surfaces may protect an air hose coupling attached to the recessed inlet from contact (falls/bumps) that may otherwise damage one or more of the air hose coupling or the recessed inlet while the lifting device is being stored, deployed, or used.

In the following description of the various embodiments, reference is made to the accompanying drawings, which form a part hereof, and in which is shown by way of illustration various embodiments in which aspects of the disclosure may be practiced. It is to be understood that other embodiments may be utilized and structural and functional modifications may be made without departing from the scope and spirit of the present disclosure.

Figure 1:
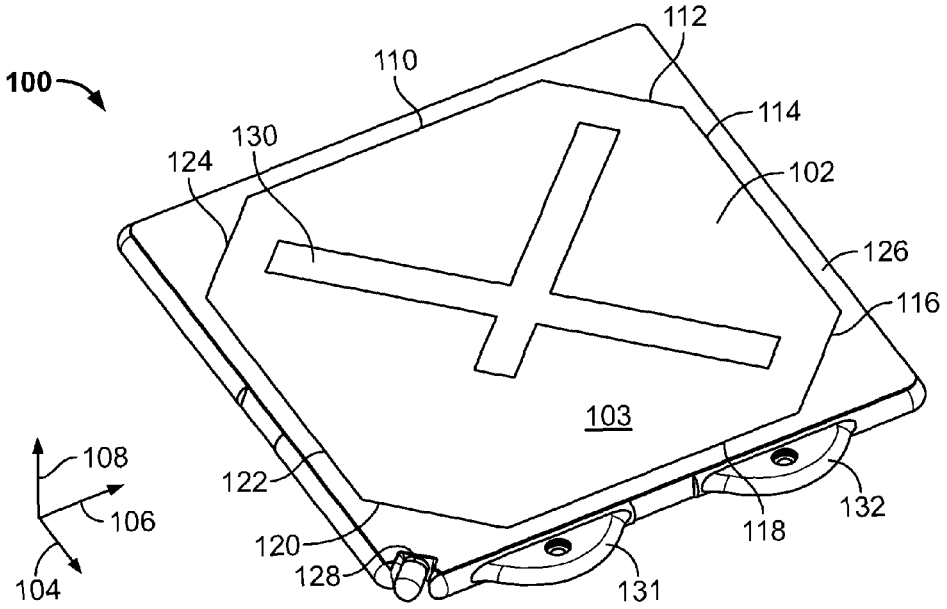
FIG. 1 depicts an isometric view of a lifting device in a deflated configuration, according to one or more aspects described herein.

FIG. 1 schematically depicts an isometric view of a lifting device 100. In one example, the lifting device 100 may be utilized by emergency service personnel, or other users, in time-sensitive situations when there is a need to lift, or otherwise separate a first object from a second object or surface. In this regard, the lifting device 100 may be utilized to, in one example, lift a portion of a vehicle following a collision, or a section of a collapsed structure. In other examples, the lifting device 100 may be utilized to raise a portion of a vehicle to facilitate tire repair, jack a portion of a vehicle, position heavy machinery, or to pry open a gap between two structures to free a trapped person or object, among others. However, additional applications for the lifting device 100 may be envisioned beyond the examples presented herein, and without departing from the scope of these disclosures.

Figure 2:
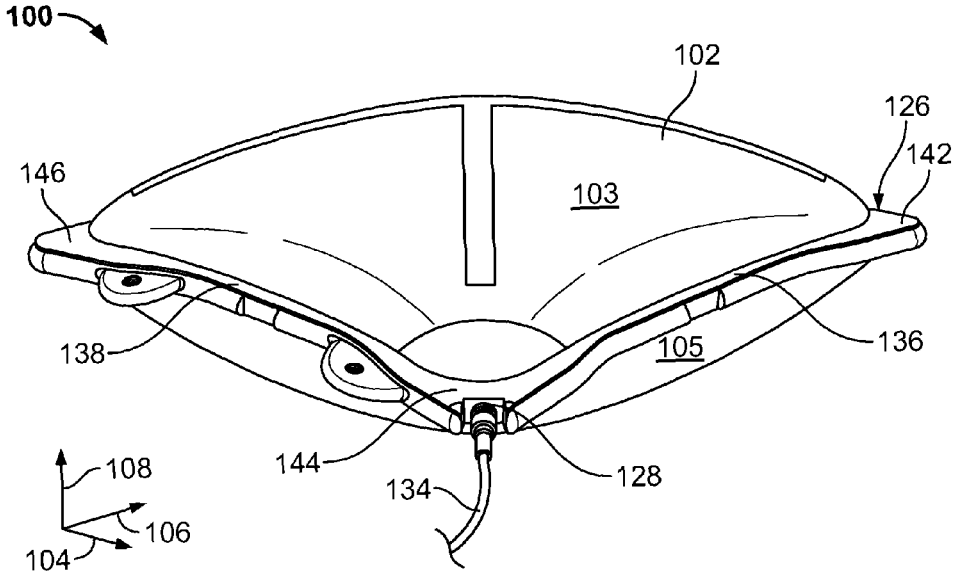
FIG. 2 depicts an isometric view of a lifting device in an inflated configuration, according to one or more aspects described herein.

In one implementation, the lifting device 100, otherwise referred to as an emergency lifting device 100, may have a lifting bag 102 configured to expand substantially along a first direction 108 upon being filled with a compressed gas (e.g. air, oxygen, nitrogen, helium, among others, or a combination of two or more gases). As such, FIG. 1 schematically depicts the lifting device 100 in a deflated, or contracted, configuration. In turn, FIG. 2 schematically depicts the lifting device 100 in an inflated, or expanded, configuration.

In one example, and as depicted FIG. 1, the lifting device 100 may have a substantially rectangular or square shape. Accordingly, the lifting bag 102 may have a top surface 103, a bottom surface 105 (see FIG. 4), and at least four sides. In one example, the four sides of the lifting bag 102 may include sides 110, 114, 118, and 122. In another implementation, the lifting bag 102 may have eight sides, including sides 110-124. In one example, the lifting bag 102 may be coupled to an envelope structure 126. The envelope structure 126 may extend around a perimeter (e.g. sides 110-124) of the lifting bag 102, and provide structural rigidity to the lifting device 100. In another example, the envelope structure 126 may provide durability to the lifting device 100, such that the envelope structure 126 may be configured to absorb a portion of energy (e.g. bumps/falls) associated with the lifting device 100 being deployed (e.g. while the lifting device 100 is being maneuvered into position while in a deflated configuration, as depicted in FIG. 1). Accordingly, the envelope structure 126 may extend out from the lifting bag 102 in a plane that includes those directions 104 and 106. In one example, directions 104, 106, and 108 may be mutually perpendicular to one another.

In one implementation, an outer edge of the envelope structure 126 may have a first geometry (e.g. a substantially rectangular shape, as depicted in FIG. 1), and the lifting bag 102 may have a second geometry (e.g. a substantially rectangular shape, or a substantially octagonal shape, among others). In other examples, the lifting bag 102 may have a number of sides ranging from 3-12 sides. Similarly, the envelope structure 126 may have an outer edge with a predominant geometry including a number of sides ranging from 3-12 sides. In another example, the lifting bag 102 and/or the envelope structure 126 may have an elliptical (e.g. circular) shape.

In one example, the lifting bag 102 may comprise a sidewall (e.g. top surface 103, bottom surface 105, and/or sides 110-124) constructed from an aramid-reinforced neoprene. In one specific example, the sidewall of the lifting bag 102 may comprise three layers of an aramid material to reinforce a neoprene material. In other examples, however, the lifting bag 102 may utilize fewer than three layers, or more than three layers of an aramid material to reinforce a meet neoprene material, without departing from the scope of these disclosures. In other example embodiments, other reinforcement material(s), e.g. other fiber material(s), may be used in addition to or in place of aramid material. In some example embodiments, other material(s), e.g. other rubber and/or polymer material(s), may be used in addition to or in place of neoprene material. In one implementation, an outer surface of the sidewall of the lifting bag 102 (e.g. the top surface 103 and/or the bottom surface 105) may include a dimpled structure. As such, the raised dimples may be configured to provide added traction, and such that the lifting bag 102 may grip to one or more surfaces with which it is placed in contact. In one example, the dimples of the top surface 103 and/or the bottom surface 105 may be embodied with any size, without departing from these disclosures. Similarly, the top surface 103 and/or the bottom surface 105 may be embodied with additional or alternative grip textures/patterns, without departing from the scope of these disclosures.

The envelope structure 126 may be formed using a variety of materials, including any of the materials discussed above in reference to the lifting bag. In some examples, the envelope structure 126 may be formed from one or more polymers, and in certain embodiments may comprise an elastomer. In one example, the envelope structure 126 may be manufactured using one or more molding processes. As such, these molding processes may include, among others, injection molding or compression molding. Additionally, those of ordinary skill in the art will recognize various specific techniques in addition to, or as an alternative to those described molding processes, for molding one or more polymers that may be utilized to produce the envelope structure 126, without departing from the scope of these disclosures. In one implementation, the envelope structure 126 may comprise one or more metal or alloy elements. As such, the one or more metal or alloy elements may be overmolded into the envelope structure 126. As one example, a recessed inlet 128 may be overmolded into the envelope structure 126.

In one implementation, the lifting device 100 may include a marking 130, configured to indicate a center of the lifting device 100. In one example, and as schematically depicted FIG. 1, the marking 130 may be approximately "X" shaped, and such that a center of the "X" shaped marking corresponds to a center of the lifting device 100. However, additional or alternative symbols may be utilized in place of marking 130 to indicate a center of the lifting device 100, without departing from the scope of these disclosures (e.g. bull's-eye symbol, among others).

In one example, the lifting device 100 may comprise two tethering structures 131 and 132. In one implementation, the tethering structures 131 and 132 may comprise eyelets configured to receive one or more coupling elements (bolts, hooks, shackles, cables, ropes, or ties, among others), such that the lifting device 100 may be coupled to an external structure (e.g. an external surface) to prevent movement of the lifting device 100 while it is being inflated/actuated. The eyelets may be used with e.g. rope in applications where the bag needs to be lowered into a particular position. In another example, the lifting device 100 may comprise a single tethering structure (131 or 132), or more than two tethering structures (131 and 132). In yet another example, a first tethering structure may be on a first side of the envelope structure 126 (e.g. a first side of the envelope structure 126 parallel to the side 118 of the lifting bag 102), and a second tethering structure may be on a second side, different to the first side, of the envelope structure 126.

The top surface 103 and the bottom surface 105 of the lifting bag 102 may be substantially planar when the lifting bag is in a deflated configuration, as depicted FIG. 1. In contrast, FIG. 2 schematically depicts the lifting device 100 in an inflated configuration. The lifting device 100 may be expanded from the deflated configuration depicted in FIG. 1 to the inflated configuration depicted in FIG. 2 by filling the lifting bag 102 with a compressed gas (e.g. air, oxygen, nitrogen, helium, among others). As such, the compressed gas may be introduced into a cavity of the lifting bag 102 through the recessed inlet 128, and from a gas source line (e.g. compressed air hose) 134.

In one example, the lifting bag 102 may be configured to expand substantially along direction 108 (i.e. along the direction of the arrow 108, or along the associated negative direction of arrow 108 (180° opposite direction to arrow 108)). In one implementation, as the lifting bag 102 is expanded from a deflated configuration, as depicted in FIG. 1, to an inflated configuration, as depicted in FIG. 2, a portion of the envelope structure 126 may be configured to deflect towards a center of the lifting device 100 (e.g. contract). For example, those sides 136 and 138 (as well as two additional sides, not visible in FIG. 2) of the envelope structure 126 may be configured to deflect towards a center of the lifting device 100 as the lifting bag 102 is expanded to the inflated configuration depicted in FIG. 2. In one implementation, sides 136 and 138 of the envelope structure 126 may be configured to deflect (contract) substantially along a plane defined by (co-planar with) directions 104 and 106. In one implementation, as the lifting bag 102 is expanded from the deflated configuration to the inflated configuration, a portion of the envelope structure 126 may be configured to retain a same geometry (i.e. not deform). For example, corners 142, 144, and/or 146 (as well as an additional corner not depicted FIG. 2) of the envelope structure 126 may be configured to retain a same geometry between the deflated configuration of FIG. 1 and the inflated configuration of FIG. 2.

The expanded configuration of the lifting bag 102, as depicted in FIG. 2, may be reached when an internal pressure in the lifting bag 102 reaches approximately 150 psi (approx. 10 bar). However, in other implementations, the expanded configuration of the lifting bag 102, as depicted in FIG. 2, may be reached when an internal pressure in the lifting bag 102 reaches a pressure value in the range of 50 psi to 400 psi (approx. 3.4 bar to 27.6 bar). Further, the lifting device 100, including various sub-components described throughout this disclosure, may be configured to withstand an internal pressure within a cavity of the lifting bag 102 of at least approx. 600 psi (approx. 41 bar) before failure. In other examples, the lifting device 100 may be configured to withstand an internal pressure within a cavity of the lifting bag 102 of at least approximately 200 psi (approx. 13.8 bar), at least approximately 300 psi (approx. 20.7 bar), at least approximately 400 psi (approx. 27.6 bar), at least approximately 500 psi (approx. 34.5 bar), at least approximately 700 psi (approx. 48.3 bar), or at least approximately 800 psi (approx. 55.2 bar), among others.

Figure 3:
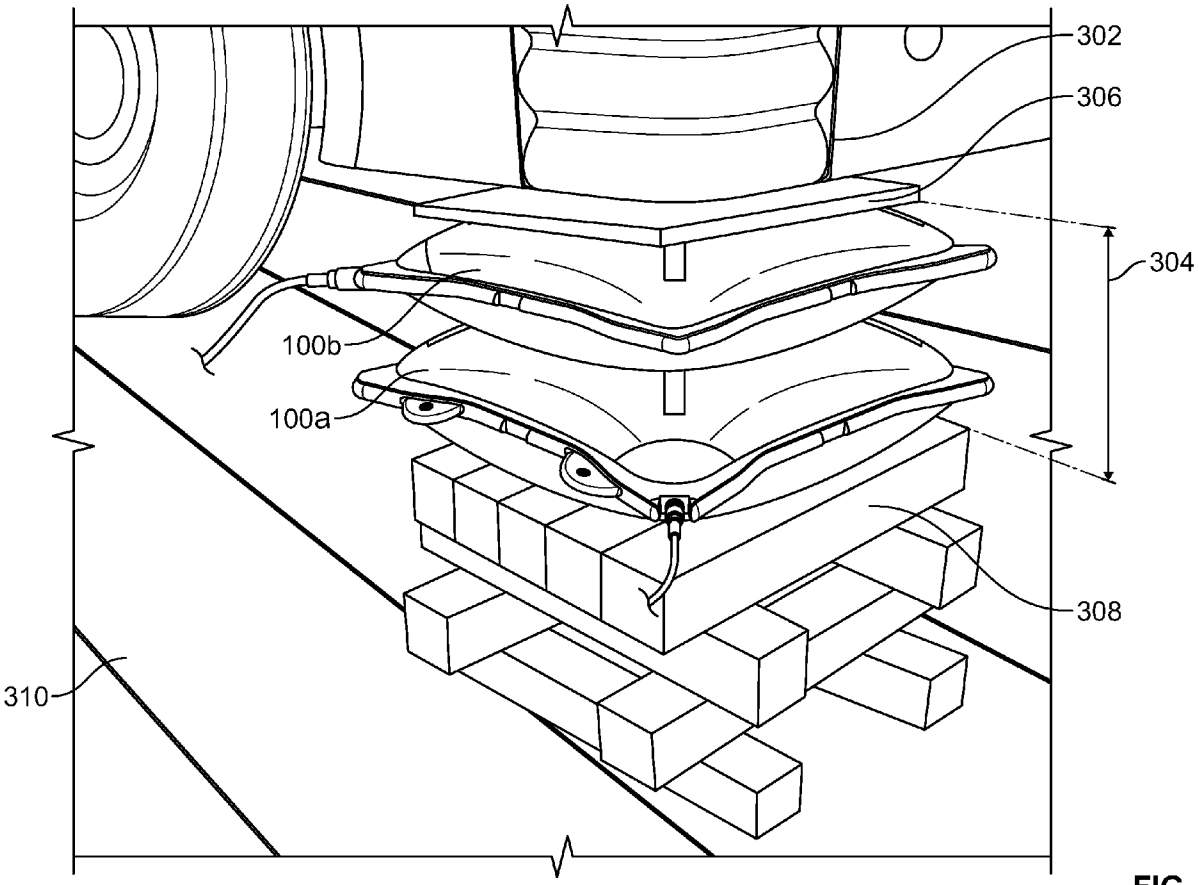
FIG. 3 schematically depicts two lifting devices used to lift a portion of an object, according to one or more aspects described herein.

FIG. 3 schematically depicts two lifting devices 100*a* and 100*b* used to lift a portion of an object 302. Accordingly, lifting devices 100*a* and 100*b* may be similar to lifting device 100, as described in relation to FIG. 1 and FIG. 2. In one implementation, the two lifting devices 100*a* and 100*b* may be positioned (stacked) on top of one another in order to increase a height through which object 302 may be lifted. In one implementation, object 302 may be a portion of a vehicle (e.g. a crashed vehicle), or a portion of a collapsed structure, among others. In one example, the lifting devices 100*a* and 100*b* may lift object 302 by a height 304. As such, each of the lifting devices 100*a* and 100*b* may lift the object 302 by a height of ½*(height 304). In one implementation, a force-distributing element 306 may be positioned between the lifting devices 100*a* and 100*b* and the object 302 in order to provide the lifting devices 100*a* and 100*b* with a substantially planar, rigid surface onto which to exert a lifting force. In one implementation, structure 308 may represent one or more structural elements positioned beneath the lifting devices 100*a* and 100*b* when in a deflated configuration in order to span a gap between the object 302 to be lifted, and a substantially rigid surface 310 away from which the object 302 is to be lifted.

Figure 4A:
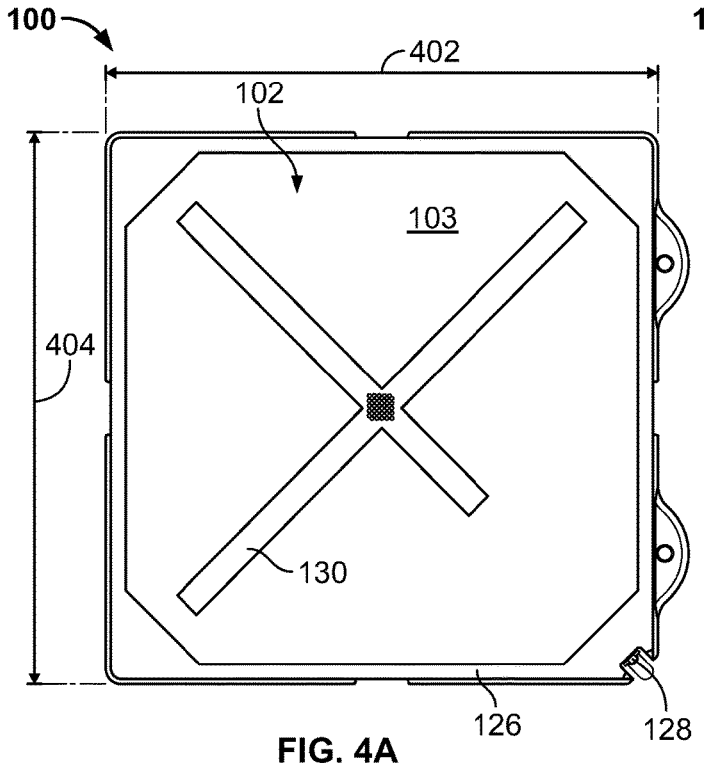
FIGS. 4A-4C schematically depict top, side, and bottom views of a lifting device, according to one or more aspects described herein.
Figure 4B:
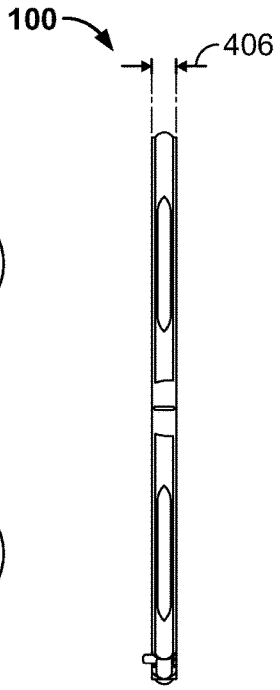
Figure 4C:
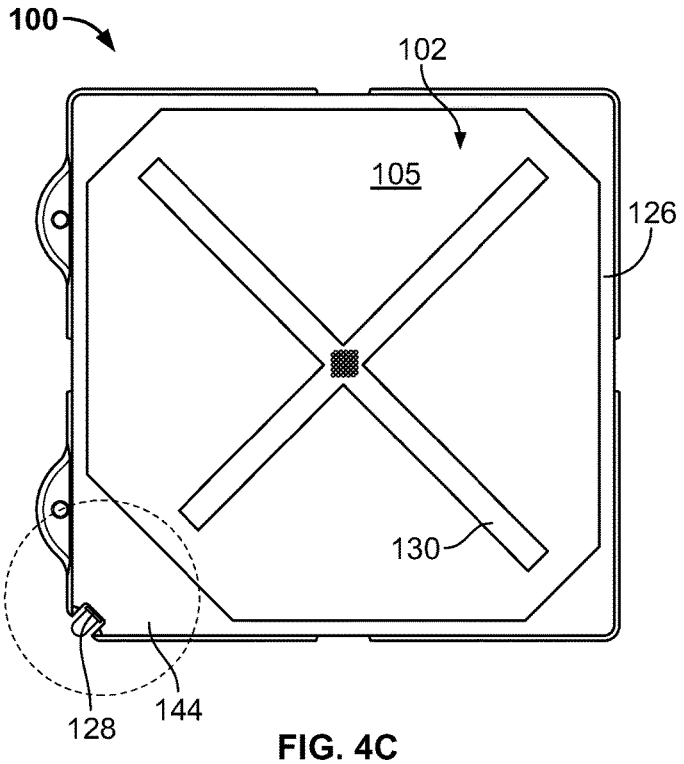

FIGS. 4A-4C schematically depict top (plan), end, and bottom views, respectively, of the lifting device 100. In particular, FIGS. 4A-4C schematically depict the lifting device 100 in a deflated configuration (otherwise referred to as a contracted, or initial configuration), and such that the top surface 103 and the bottom surface 105 of the lifting device 100 are substantially planar. In one implementation, the lifting device 100 may have a substantially rectangular (square) shape. In particular, the lifting device 100 may have a length 402, a width 404, and a thickness 406 when in a deflated configuration, as depicted in FIGS. 4A-4C. In one example, a height through which the lifting device 100 may expand (e.g. along the direction associated with height 304, from FIG. 3), may depend upon the size of the lifting device (e.g. length 402 and width 404). Accordingly, in one example, the length 402 may range from approximately 6 inches (approximately 152 mm) to approximately 37 inches (approximately 939 mm). Further, the width 404 may range from approximately 6 inches (approximately 152 mm) to approximately 37 inches (approximately 939 mm). In one implementation, the length 402 may be approximately equal to the width 404. However, in another implementation, the length 402 may not be equal to the width 404, and such that device 100 has a substantially rectangular shape. In yet another implementation, length 402 and width 404 may be embodied with any dimensional values below 6 inches, or above 37 inches, without departing from the scope of these disclosures. In another example, a shape of the lifting device 100 may be non-quadrilateral. For example, a shape of the lifting device may, in alternative implementation, be triangular, pentagonal, hexagonal, heptagonal, octagonal, nonagonal, decagonal or more (e.g. have a number of sides ranging from 3-10 or more). In one example, thickness 406 may range from approximately ¾ of an inch (approximately 19 mm) to approximately 1 inch (approximately 25 mm). In another example, thickness 406 may be less than three quarters of an inch, or more than 1 inch, without departing from the scope of these disclosures.

Figure 5:
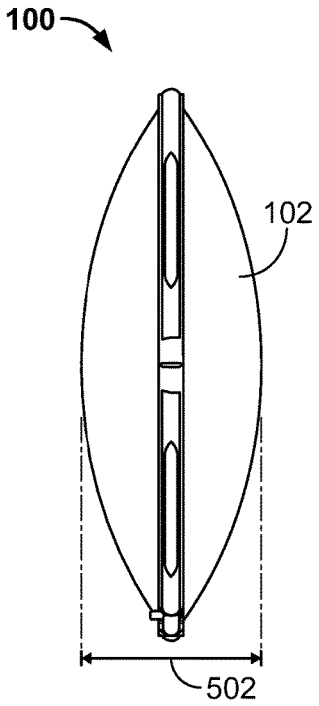
FIG. 5 schematically depicts an end view of a lifting device in an inflated configuration, according to one or more aspects described herein.

FIG. 5 schematically depicts an end view of a lifting device 100 in an inflated configuration (otherwise referred to as an expanded configuration). As such, the lifting device 100 may be configured to expand to a maximum lifting height 502. In one implementation, and as previously described, the maximum lifting height 502 may be reached when an internal pressure in the lifting bag 102 reaches approximately 150 psi (approximately 10 bar). In one example, the lifting height 502 may range from approximately 1 inch (approximately 25 mm) to approximately 20 inches (approximately 508 mm). In another implementation, the lifting device 100 may be configured to expand to different heights, and such that the maximum lifting height 502 may be less than 1 inch, or more than 20 inches, without departing from the scope of these disclosures.

In one implementation, the lifting device 100 may be configured to lift a mass ranging from approximately 1.5 tons (approximately 1360 kg) to approximately 90 tons (approximately 81,646 kg). In some embodiments, the lifting device 100 may be configured to lift a mass ranging from approximately 25 tons to approximately 90 tons, in certain embodiments from approximately 40 tons to approximately 90 tons, and in some examples from approximately 70 tons to approximately 90 tons. However, the lifting device 100 may be configured to lift a mass below 1.5 tons, or above 90 tons, without departing from the scope of these disclosures.

Figure 6A:
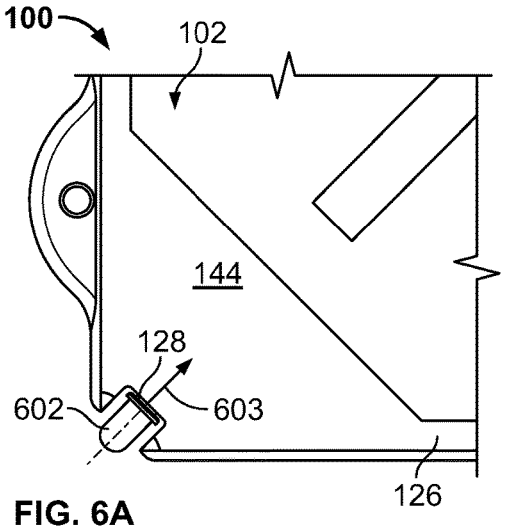
FIGS. 6A and 6B schematically depict a portion of a lifting device, according to one or more aspects described herein.
Figure 6B:
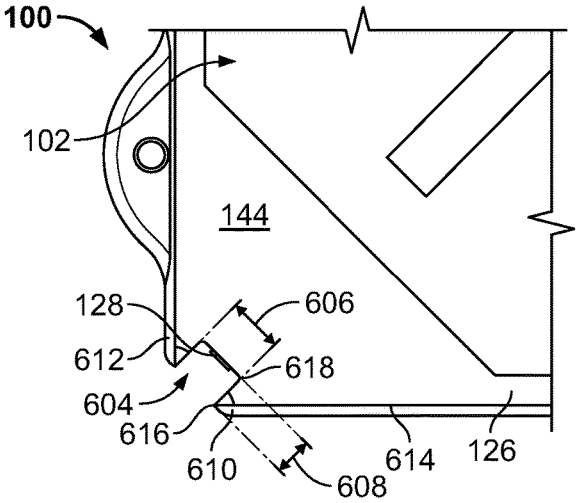

FIGS. 6A and 6B schematically depict a portion of the lifting device 100. In particular, FIGS. 6A and 6B schematically depict plan views of corner 144 of the lifting device 100. As such, the lifting device 100 may be embodied with a recessed inlet 128 that may be molded into the envelope structure 126. In one specific example, the recessed inlet 128 may be overmolded into the envelope structure 126 at corner 144 the lifting device 100. In one example, the recessed inlet 128 may be utilized to inject compressed gas (e.g. air) through the envelope structure 126, and into a cavity of the lifting bag 102. In one example, a compressed gas may be injected into the lifting device 100 through an inlet hose (e.g. gas source line 134 from FIG. 2). However, when the lifting device 100 is stored, or being deployed (e.g. before gas source line 134 is connected), a protective cap 602 (otherwise referred to as a nipple cap 602) may be received into the recessed inlet 128. As such, the protective cap 602 may prevent debris from entering into the recessed inlet.

In one example, the recessed inlet 128 may extend through the envelope structure 126 and to or into the lifting bag 102 substantially along that direction indicated by arrow 603. As such, in one example, direction 603 may be substantially perpendicular to direction 108, as indicated in FIG. 1 and FIG. 2.

In one example, the recessed inlet 128 may be positioned within a notch section 604 of the envelope structure 126. In one implementation, the notch section 604 may have a depth 608 and a width 606. As such, the depth 608 and with 606 may be embodied with any dimensional values, without departing from the scope of this disclosure.

In one implementation, the notch section 604 may provide protection to the recessed inlet, or a component coupled thereto, from contact during storage, deployment, or use of the lifting device 100. In particular, the notch section 604 may provide protective bumper surfaces 610 and 612 at an outer edge 614 of the envelope structure 126. In this way, the outer edge 614 (and in one specific example, point 616 on the outer edge 614) of the envelope structure 126 may be a first distance from a center of the lifting device 100 (e.g. center indicated by marking 130). Further, the recessed inlet 128 may extend in the direction 603 from an outer edge of the notch section 604 (e.g. outer edge 618 of notch section 604), and such that the outer edge 618 may be a second distance, less than the first distance, from the center of the lifting device 100. In one example, the protective bumper surfaces 610 and 612 may be proximate to the recessed inlet 128. As such, in one implementation, the protective bumper surfaces 610 and 612 may be configured to absorb at least a portion of a force associated with the lifting device 100 being hit, bumped, knocked, and/or dropped while being placed in position to lift an object (deployed), while in use (i.e. while the lifting device 100 is being inflated from a deflated configuration to inflated configuration (or vice versa)), or while the lifting device 100 is being stowed and/or stored. In this way, one or more of the protective bumper surfaces 610 and 612 may absorb at least a portion of a force that may otherwise be transmitted to one or more of the recessed inlet 128, and/or a device coupled thereto (e.g. coupler device 802). As such, one or more of the protective bumper surfaces 610 and 612 may reduce or prevent wear or damage to the recessed inlet 128 or the coupler device 802.

Figure 7:
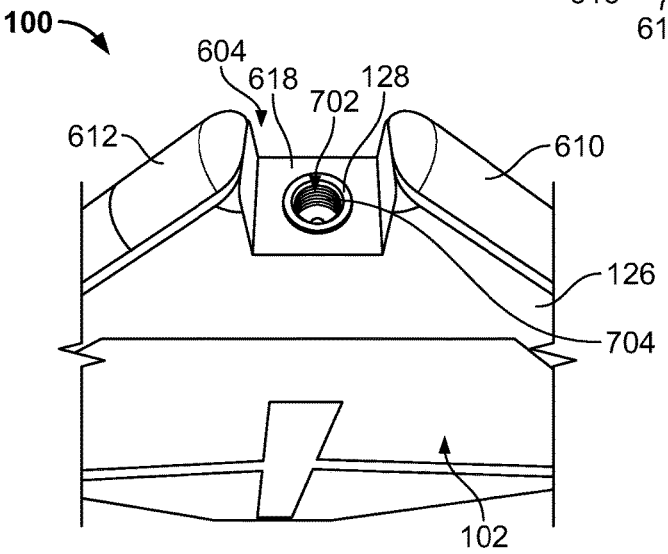
FIG. 7 schematically depicts an isometric view of a recessed inlet positioned within a notch section of a lifting device, according to one or more aspects described herein.

FIG. 7 schematically depicts an isometric view of the recessed inlet 128 positioned within the notch section 604 of the lifting device. In one example, the recessed inlet 128 may comprise a structure constructed from one or more metals or alloys. In one example, the recessed inlet 128 may comprise a brass structure. In other examples, the recessed inlet 128 may be constructed from a steel or an aluminum (or alloys thereof), among others. In one implementation, the recessed inlet 128 may comprise a bore 702 configured to receive one or more standardized coupling sizes. In particular, the recessed inlet 128 may have a portion of an axial length with a threaded sidewall 704. As such, the bore 702, and the threaded sidewall 704 may comprise any diameter and/or thread size known to those of ordinary skill in the art. In one specific example, the bore 702 may measure approximately ¼ inch. In one implementation, the recessed inlet 128 may be configured to receive standardized couplings configured to handle compressed gas (e.g. compressed air). In one example, the recessed inlet 128 may be configured to receive a threaded nipple device (e.g. air hose nipple) (see FIG. 8). In one implementation, the recessed inlet 128, and the threaded sidewall 704, may comprise a left-hand thread. However, in another implementation, the threaded sidewall 704 may comprise a right-hand thread, without departing from the scope of these disclosures.

Figure 8:
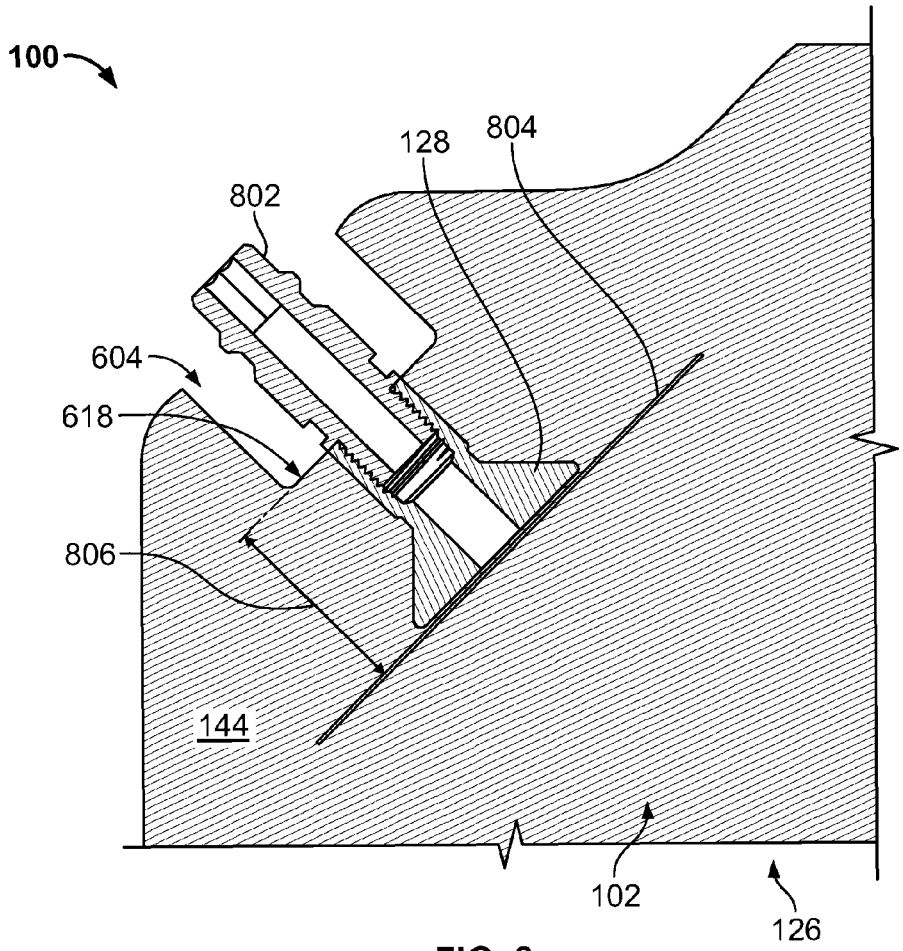
FIG. 8 schematically depicts a cross-sectional view of a portion of a lifting device, according to one or more aspects described herein.

FIG. 8 schematically depicts a cross-sectional view of a portion of the lifting device 100. In particular, FIG. 8 schematically depicts corner 144 of the envelope structure 126. As previously described, the recessed inlet 128 may extend from an outer edge (or outer surface) 618 of the notch section 604 to an internal cavity of the lifting bag 102 through the envelope structure 126. In one example, line 804 schematically represents a boundary between the lifting bag 102 and the envelope structure 126. In one example, the recessed inlet 128 may be configured to receive a coupler device 802 (e.g. air hose nipple 802, or inflation nipple 802). As such, various configurations of the coupler device 802 (e.g. industrial standard air coupling configurations, among others) may be utilized to couple to the recessed inlet 128, without departing from the scope of these disclosures. As illustrated in FIG. 8, the recessed inlet 128 may have an inlet length 806. In some examples, the inlet length is such that the recessed inlet is entirely contained within the envelope structure 126 and does not protrude into the notch section 604 or into the lifting bag 102 at all. In various examples, the inlet length is such that the recessed inlet does not protrude into the lifting bag area at all, but may protrude a distance into the notch section 604. In others, the recessed inlet may slightly protrude into the lifting bag cavity, or may extend to a cavity or channel in the envelope structure that meets the internal cavity of the lifting bag so as to allow the flow of air into the cavity via the recessed inlet. In certain examples, the inlet length 806 is approximately equal to the notch section depth 608, while in certain embodiments it is greater than the notch section depth, for example approximately 125% or 135% of the notch section length. In various examples, the inlet length is approximately 0.875 inches. In some examples the inlet length is between approximately 0.8 inches and 1.0 inches, while in others it is about 1.0 inches or less, or 0.8 inches or less.

Figure 9:
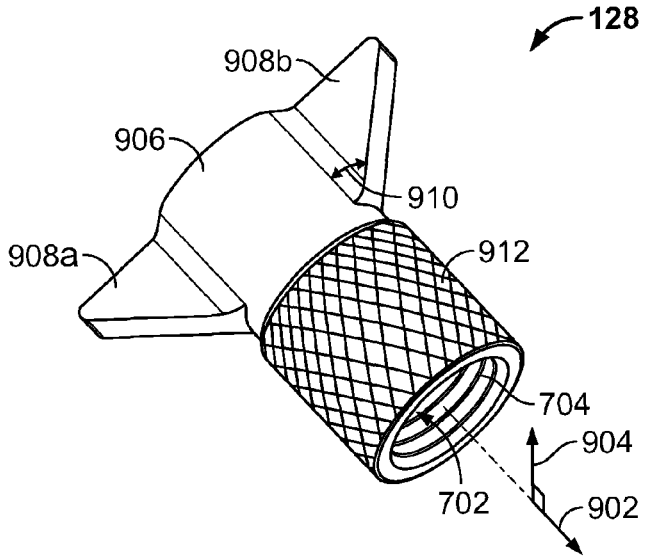
FIG. 9 schematically depicts a structure of a recessed inlet, according to one or more aspects described herein.

FIG. 9 schematically depicts a structure of the recessed inlet 128. In one example, the recessed inlet 128 may comprise a substantially cylindrical body 906, while in other examples the inlet may comprise other shapes, both geometric and non-geometric. Accordingly, an axial direction 902 may be defined relative to the substantially cylindrical body 906. Additionally, a radial direction 904, perpendicular to the axial direction 902, may be defined as shown in FIG. 9. In one implementation, the recessed inlet 128 may comprise two wing structures 908*a* and 908*b* coupled to an outer surface of the cylindrical body 906. The wing structures 908*a* and 908*b* may extend in a radial direction (e.g. co-planar with radial direction 904). In one example, the wing structures 908*a* and 908*b* may be configured to increase a surface area to be overmolded into the envelope structure 126. In this way, the increased surface area may increase adhesion/gripping between the overmolded envelope structure 126 and the recessed inlet 128.

In one example, the bore 702 has an axial length extending along the axial direction 902. As such, at least a portion of the axial length of the bore 702 may comprise the threaded sidewall 704.

In one implementation, the wing structures 908*a* and 908*b* may provide increased resistance to an internal pressure exerted by a mass of gas (e.g. air) within the lifting bag 102 of the lifting device 100. As such, the recessed inlet 128 may resist an internal pressure along a direction opposite to that shown by arrow 603 from FIG. 6A. In other implementations, the recessed inlet 128 may be embodied with a single wing structure 908, or three or more wing structures 908, without departing from the scope of these disclosures. In various embodiments, the recessed inlet may not have any wing structures. In one example, an angle 910 of wing structure 908 may measure approximately 45°. In another example, angle 910 of wing structure 908 may range between approximately 5°, and approximately 175°, or between approximately 30°, and approximately 90° without departing from the scope of these disclosures. In certain embodiments, no surfaces of the wing structure are perpendicular or substantially perpendicular to the cylindrical body, but both form an angle thereto, where these angles may be equal or substantially equal to each other, or may be dissimilar to each other. In some examples, the wings structure(s) may each comprise two sides that are substantially perpendicular to and extend out from the cylindrical body 906, and are connected a distance away from the cylindrical body. In some embodiments, a single wing structure may extend around the entire diameter of the cylindrical body.

In one example, the recessed inlet 128 may have a textured portion 912 of an outer surface of the substantially cylindrical body 906. Accordingly, in one example, the textured portion 912 may be configured to provide an increased surface area for improving adhesion between the recessed inlet 128 and the overmolded envelope structure 126. As such, the textured portion 912 may be embodied with any pattern of dimples or other raised elements, without departing from the scope of these disclosures.

Figure 10:
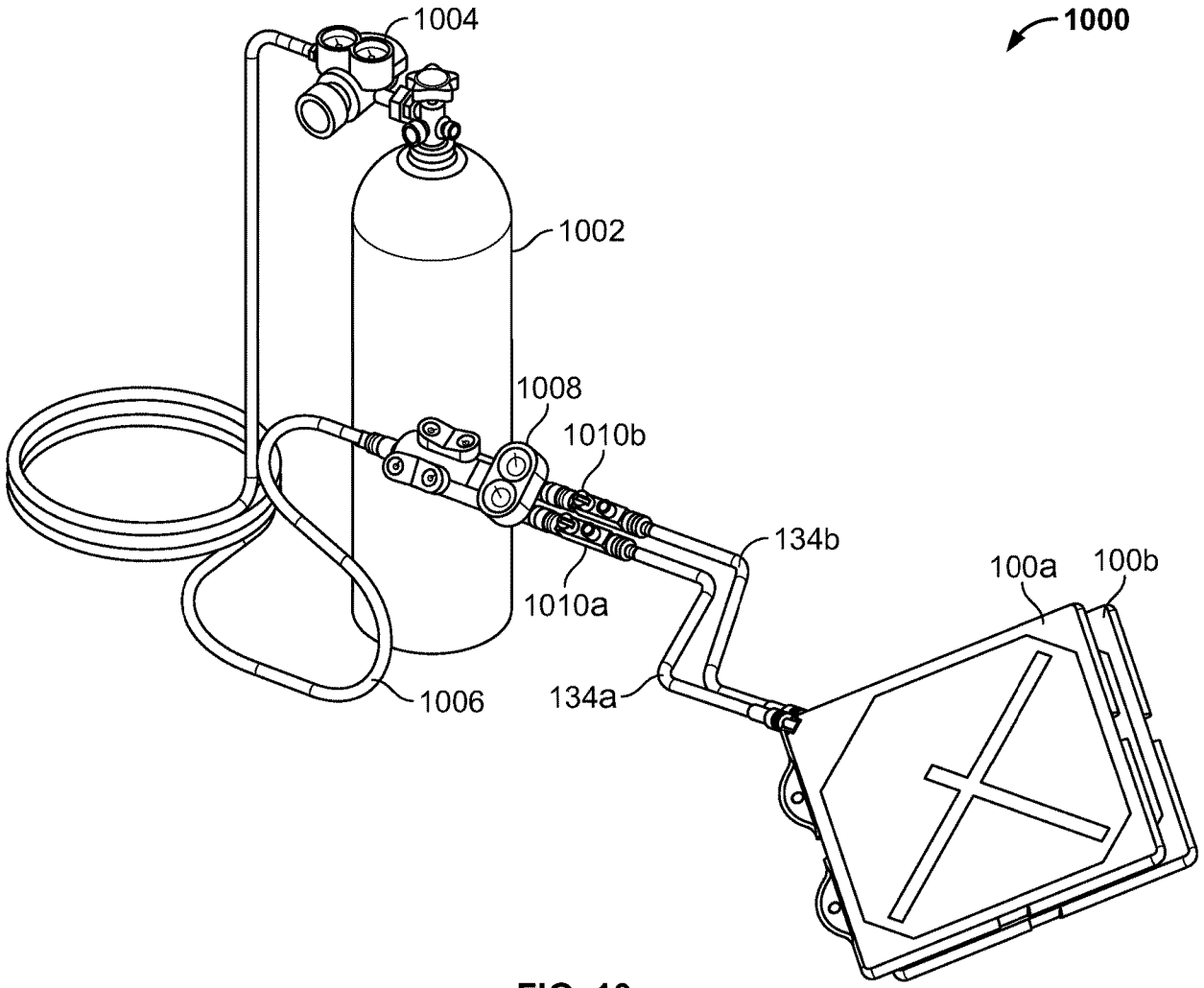
FIG. 10 schematically depicts a system for inflating a lifting device, according to one or more aspects described herein.

FIG. 10 schematically depicts a system 1000 for inflating lifting devices 100*a* and 100*b*. As such, those two lifting devices 100*a* and 100*b* depicted in FIG. 10 represent one configuration of system 1000. Accordingly, system 1000 may be utilized with a single lifting device 100, or with two or more lifting devices, without departing from the scope of the disclosures described herein. In one example, system 1000 may comprise a gas source 1002. In one implementation, gas source 1002 may be an air source 1002, and may comprise a pressurized canister of air. As such, air source 1002 may be embodied with any materials and/or dimensions configured to store pressurized air. In another implementation, the gas source 1002 may be configured to store pressurized oxygen, nitrogen, helium, or another gas that may be utilized to inflate a lifting device 100. The system 1000 may additionally utilize a pressure regulator 1004. As such, the pressure regulator 1004 may comprise a mechanism configured to reduce a high internal gas pressure within the gas source 1002 down to a working pressure that may be utilized to inflate one or more lifting devices 100*a* and 100*b*. Accordingly, the pressure regulator 1004 may be embodied with any specific pressure regulator designs/mechanisms, without departing from the scope of these disclosures. Element 1006 may be an interconnecting hose configured to deliver pressurized gas between the regulator 1004 and a controller mechanism 1008. As such, the interconnecting hose 1006 may comprise any length or inner/outer diameters configured to handle a pressurized gas stored within source 1002. Controller mechanism 1008 may comprise one or more manually operated controls as well as one or more output meters (e.g. pressure meters) configured to allow a user to manually control flow of gas into, or out from the lifting devices 100*a* and 100*b*. Additionally, the system 1000 may include one or more safety valves (e.g. safety valves 1010*a* and 1010*b*). In one particular implementation, safety valves 1010*a* and 1010*b* may be pressure relief valves, among others. In one example, the safety valves 1010*a* and 1010*b* may be configured to keep the lifting devices 100*a* and 100*b* in an inflated configuration (e.g. that inflated configuration depicted in FIG. 5) when the controller mechanism 1008, and/or the interconnecting hose 1006, the regulator 1004, and the source 1002, are disconnected from the lifting devices 100*a* and 100*b*. In another example, the safety valves 1010*a* and 1010*b* may be configured to relieve excess pressure within a lifting bag 102 due to shifting loads and/or temperature changes associated with the lifting devices 100*a* and 100*b*.

The present disclosure is disclosed above and in the accompanying drawings with reference to a variety of examples. The purpose served by the disclosure, however, is to provide examples of the various features and concepts related to the disclosure, not to limit the scope of the invention. One skilled in the relevant art will recognize that numerous variations and modifications may be made to the examples described above without departing from the scope of the present disclosure.

We claim:

1. A lifting device, comprising:

a lifting bag configured to expand in a first direction between a deflated configuration and an inflated configuration upon being filled with compressed air, the lifting bag comprising a top surface, a bottom surface, and eight sides;

an envelope structure, coupled to the eight sides of the lifting bag, and comprising a substantially rectangular outer perimeter, the envelope structure further comprising:

a first outer edge at a first distance from a center of the lifting device;

a notch section comprising a second outer edge at a second distance, less than the first distance, from the center of the lifting device;

a recessed inlet, molded into the envelope structure, and extending in a second direction, perpendicular to the first direction, from the second outer edge of the envelope structure to a cavity of the lifting bag, the recessed inlet further comprising:

a substantially cylindrical body;

at least two wing structures coupled to an outer surface of the cylindrical body, and extending in a radial direction relative to the substantially cylindrical body, the at least two wing structures configured to resist an internal pressure exerted by a mass of air within the lifting bag when in the inflated configuration; and a bore comprising an axial length extending between the second outer edge of the envelope structure and the cavity of the lifting bag, at least a portion of the axial length comprising a threaded sidewall, wherein at least a portion of the envelope structure is configured to deflect towards the center of the lifting device when the lifting bag is expanded between the deflated and inflated configurations.

2. The lifting device of claim 1, wherein the top surface and the bottom surface are substantially planar when the lifting bag is in the deflated configuration.

3. The lifting device of claim 1, wherein the lifting bag comprises an aramid-reinforced neoprene.

4. The lifting device of claim 1, wherein the envelope structure comprises a molded polymer.

5. The lifting device of claim 1, wherein the threaded sidewall of the bore of the recessed inlet is configured to receive an inflation nipple coupling.

6. The lifting device of claim 1, wherein the lifting bag inflates to the expanded configuration when an internal pressure in the lifting device reaches approximately 150 psi.

7. The lifting device of claim 1, wherein the recessed inlet is configured to withstand at least 600 psi of internal pressure exerted by a mass of air within the lifting bag.

8. The lifting device of claim 1, wherein the envelope structure further comprises:

two rounded tethering structures coupled to and extending from a first side of the substantially rectangular outer perimeter of the envelope structure.

9. A lifting device, comprising:

a lifting bag configured to expand in a first direction between a deflated configuration and an inflated configuration upon being filled with a compressed gas, the lifting bag comprising a top surface, a bottom surface, and eight sides;

an envelope structure coupled to the eight sides of the lifting bag, and comprising a substantially rectangular outer perimeter, the envelope structure further comprising:

a notch section comprising at least one protective bumper surface proximate a recessed inlet, the recessed inlet molded into the envelope structure, and extending in a second direction, perpendicular to the first direction, from an outer edge of the notch section to a cavity of the lifting bag, the recessed inlet further comprising:

a substantially cylindrical body;

at least one adhesion structure configured to resist an internal pressure exerted by a mass of gas within the lifting bag when in the inflated configuration; and a bore comprising an axial length extending between the outer edge of the notch section and the cavity of the lifting bag, at least a portion of the axial length comprising a threaded sidewall, wherein at least a portion of the envelope structure is configured to retain a same geometry when the lifting bag is expanded between the deflated and inflated configurations.

10. The lifting device of claim 9, wherein the at least one adhesion structure comprises at least one wing structure coupled to an outer surface of the cylindrical body and extending in a radial direction relative to the substantially cylindrical body, at least one textured portion on the outer surface of the cylindrical body, or a combination thereof.

11. The lifting device of claim 9, wherein the top surface and the bottom surface comprise raised dimple structures.

12. The lifting device of claim 9, wherein the recessed inlet comprises a brass structure.

13. The lifting device of claim 9, wherein the threaded sidewall comprises a left hand threads and wherein the compressed gas is air.

14. The lifting device of claim 9, wherein an outer edge of the at least one protective bumper surface is further from a center of the lifting bag than the outer edge of the notch section.

15. The lifting device of claim 9, wherein the notch section is positioned at a corner of the envelope structure.

16. The lifting device of claim 9, wherein the top surface and the bottom surface are substantially planar when the lifting bag is in the deflated configuration.

17. The lifting device of claim 9, wherein the envelope structure further comprises:

two rounded tethering structures coupled to and extending from a first side of the substantially rectangular outer perimeter of the envelope structure.

18. A lifting device, comprising:

a lifting bag configured to expand between a deflated configuration and an inflated configuration upon being filled with a compressed gas, the lifting bag comprising a top surface, a bottom surface, and eight sides;

an envelope structure coupled to the eight sides, the envelope structure further comprising:

a notch section comprising at least one protective bumper surface proximate a recessed inlet, the recessed inlet molded into the envelope structure at the notch section, and extending from an outer edge of the envelope structure and at least to a cavity of the lifting bag, the recessed inlet further comprising:

a substantially cylindrical body; and a bore comprising an axial length extending between the outer edge of the envelope structure and the cavity of the lifting bag.

19. The lifting device of claim 18, wherein at least a portion of the axial length of the bore comprises a threaded sidewall, and wherein the threaded sidewall is configured to receive an inflation nipple coupling.

20. The lifting device of claim 18, wherein the top surface and the bottom surface are substantially planar when the lifting bag is in the deflated configuration.

21. The lifting device of claim 18, wherein the compressed gas is air.

* * * * *